US006679936B2

(12) United States Patent
Quackenbush

(10) Patent No.: US 6,679,936 B2
(45) Date of Patent: Jan. 20, 2004

(54) MOLTEN METAL DEGASSING APPARATUS

(75) Inventor: Mark S. Quackenbush, Winter Haven, FL (US)

(73) Assignee: Pyrotek, Inc., Carlisle, PA (US)

( * ) Notice: Subject to any disclaimer, the term of this patent is extended or adjusted under 35 U.S.C. 154(b) by 46 days.

(21) Appl. No.: 10/165,952

(22) Filed: Jun. 10, 2002

(65) Prior Publication Data

US 2003/0227111 A1 Dec. 11, 2003

(51) Int. Cl.[7] ..... C22B 9/05

(52) U.S. Cl. ..... 75/304; 75/414; 75/531; 75/682; 266/216; 266/220; 266/225

(58) Field of Search ..... 75/304, 414, 682, 75/531; 266/216, 225, 220

(56) References Cited

U.S. PATENT DOCUMENTS 3,972,709 A 8/1976 Chia
5,904,894 A * 5/1999 Mukohda ..... 266/220
6,099,614 A * 8/2000 Bennati ..... 75/414
6,375,712 B1 * 4/2002 Forberg et al. ..... 75/680

* cited by examiner

*Primary Examiner*—Melvyn Andrews

(57) ABSTRACT

A tool or fluxing head for fluxing molten metal that comprises a fluxing gas supply line that communicates with the interior of an inverted plunger cup providing a hollow interior into which refining agents and other additives that are to be introduced into a molten metal can be incorporated. In use, the fluxing head is introduced into a molten metal body with the plunger cup in the inverted position. The inverted plunger cup has a closed top at the point where the gas supply line enters and an open bottom that allows molten metal to enter the inverted cup to make contact with the refining agent or other additive. Apertures are provided in the wall of the inverted plunger cup to allow gas introduced therein to escape therefrom. According to a preferred embodiment, a porous layer is provided at the top of the inverted plunger cup to allow for the escape of gas into the molten metal through the porous layer.

9 Claims, 2 Drawing Sheets

MOLTEN METAL DEGASSING APPARATUS

FIELD OF THE INVENTION

The present invention relates to degassing apparatus used in the fabrication of metals such as aluminum, copper and steel and more particularly to such a device that may serve the dual function of metal degassing and additive addition in alloying or other furnace operations.

BACKGROUND OF THE INVENTION

In the fabrication of metals such as aluminum, copper and steel (hereinafter "metal"), an important part of the operation of converting the metal from a molten state to a solid and further fabricable state is the removal of gases such as hydrogen that may result in porosity or "voids" in the solid state metal. Such "voids" can result in areas within the volume of the solid metal that exhibit properties different, normally weaker, than those of the surrounding metal and give rise to the presence of stress risers that can provide initiation points for propagation of cracks or other defects in the finally fabricated metal. Accordingly, a great deal of effort in the metal refining operation is dedicated to the removal of hydrogen and similar elements that can result in a finished product that does not meet product specification properties. Such metal treatment processes are conventionally referred to as "fluxing" and is generally performed through the exposure of the molten metal to a gas or mixture of gases such as argon, chlorine, $CO_2$, CO, etc.

It is also conventional practice in such metal fabrication furnace operations to add grain refiners, alloying elements, etc. to modify/improve the properties of the metal undergoing treatment.

In fabrication operations equipped with large furnaces, e.g. 20 to 50 tons in, for example, the aluminum industry, fluxing is performed in any number of different ways using a variety of equipment. Some more recently constructed metal melting and/or holding furnaces or metal retention vessels or crucibles are equipped with porous plugs in their bottoms. A "fluxing" gas such as chlorine, argon or mixtures of same are introduced through the porous plugs and permitted to move upward through the metal contained in the furnace scavenging hydrogen as it rises. In older furnaces, not equipped with porous plugs, cylindrical "wands" or turrieres through which "fluxing" gas is introduced are manually or mechanically circulated within the body of molten metal to provide the fluxing gas to the lower portion of the molten metal body. As the gas rises it scavenges the potentially damaging hydrogen gas contained in the body of the molten metal. While the porous plug approach can be designed and implemented to provide substantially 100% treatment of the metal contained in the furnace, the affect of fluxing with wands can be variable depending upon the experience and dedication of the operator, retention time in the furnace and the design of the head or gas dispersing device attached to the end of the wand.

"Fluxing" in smaller installations is often more problematic. In such installations, for example those associated with smaller casting operations in aluminum extrusion plants and foundry casting operations, where molten metal furnaces and retention device capacities may be measured in pounds rather than tons, fluxing is often performed using wands as described above. Again, such operations offer the opportunity for under fluxing.

One device proposed to improve the fluxing operation is described in U.S. Pat. No. 3,972,709 issued Aug. 3, 1976.

The device of this patent comprises a supply conduit connected at one end to a source of pressurized gas and connected at the other end with a rotatable closed cylinder, i.e. one having a cylindrical wall, a top and a bottom, immersed in the molten metal. An array of apertures extends through the wall of the cylinder for discharging the gas into the molten metal. The apertures are arranged to discharge the gas in the form of numerous gas bubble jets in mutually cooperative jetting directions to rotationally propel the cylinder about the supply conduit. Physical contact between the molten metal and the gas within the cylinder is prevented by adequate flow of the gas through the apertures.

The addition of grain refiners and the like in such molten metal furnace operations is also accomplished in a variety of ways. In some cases solid additives are simply "dumped" or plunged into the furnace, a practice that can result in the loss of significant quantities of the additive and a lack of proper dissemination of the additive throughout the body of molten metal thus often providing a somewhat less than homogenous molten metal body. In other cases the additive(s) are injected under the molten metal surface, a practice that generally requires the use of an additional costly piece of equipment and the purchase of additives in a very specific size and formulation that must be purchased from the supplier of the injection equipment, generally at a higher cost.

Thus, there exist a number of more or less reliable methods for the individual introduction of fluxing gases and additives into molten metal in furnace operations. There does not however, to the best of my knowledge exist a device that while enhancing the dissemination of fluxing gas in fixed or movable wanding operation also offers the potential for the simultaneous introduction of additives to provide a uniform or homogeneous metal melt.

Thus, the availability of an efficient, relatively inexpensive and simple to utilize combined fluxing gas/additive introduction device or system suitable for use in molten metal handling operations would be of significant value to the metal processor. Such a device would enhance the reduction of hydrogen in processed metal while offering the potential to simultaneously improve the dissemination/dispersion of additives in such molten at a reduced cost and with simple operating procedures.

OBJECT OF THE INVENTION

It is therefore an object of the present invention to provide and improved head for molten metal fluxing devices that enhances the dispersion of fluxing gas in molten metal when a moveable of fixed wanding technique is used to introduce the fluxing gas to the molten metal.

It is another object of the present invention to provide an improved flux gas introduction device for the head of a fluxing wand that also offers the potential for the simultaneous performance of fluxing operations and the introduction of grain refiners and other metal additives in a manner that improves the dispersion/dissemination of such additives into the molten metal.

SUMMARY OF THE INVENTION

A tool or fluxing head for fluxing molten metal that comprises a fluxing gas supply line that communicates with the interior of an inverted cup providing a hollow center into which refining agents and other additives that are to be introduced into a molten metal can be incorporated. In use, the fluxing head is introduced into a molten metal body with the cup in the inverted position. The inverted cup has a closed top at the point where the gas supply line enters and an open bottom that allows molten metal to enter the inverted cup to make contact with the refining agent or other additive. Apertures are provided in the side(s) of the inverted cup to allow gas introduced therein to escape therefrom. According to a preferred embodiment, a porous medium is provided at the top of the inverted cup to allow for the escape of gas into the molten metal through the porous medium.

DETAILED DESCRIPTION

The fluxing apparatus of the present invention comprises an inverted plunger cup that is conductively attached to a fluxing gas supply conduit or line at its top or closed end. Apertures in the sides of the cup allow for the escape of fluxing gas introduced into the cup through the conduit to escape from the cup about the periphery thereof. The inverted plunger cup design allows for the introduction of grain refiner or other molten metal additives simultaneously with the fluxing operation by the placement of a suitable additive composition in a suitable form inside of the inverted cup during fluxing. The entry of molten metal into the interior of the inverted plunger cup provides for dissolution of the grain refiner or additive while the flow of fluxing gas out of the inverted plunger cup provides an excellent means for dispersing the additive into the molten metal.

Figure 1:
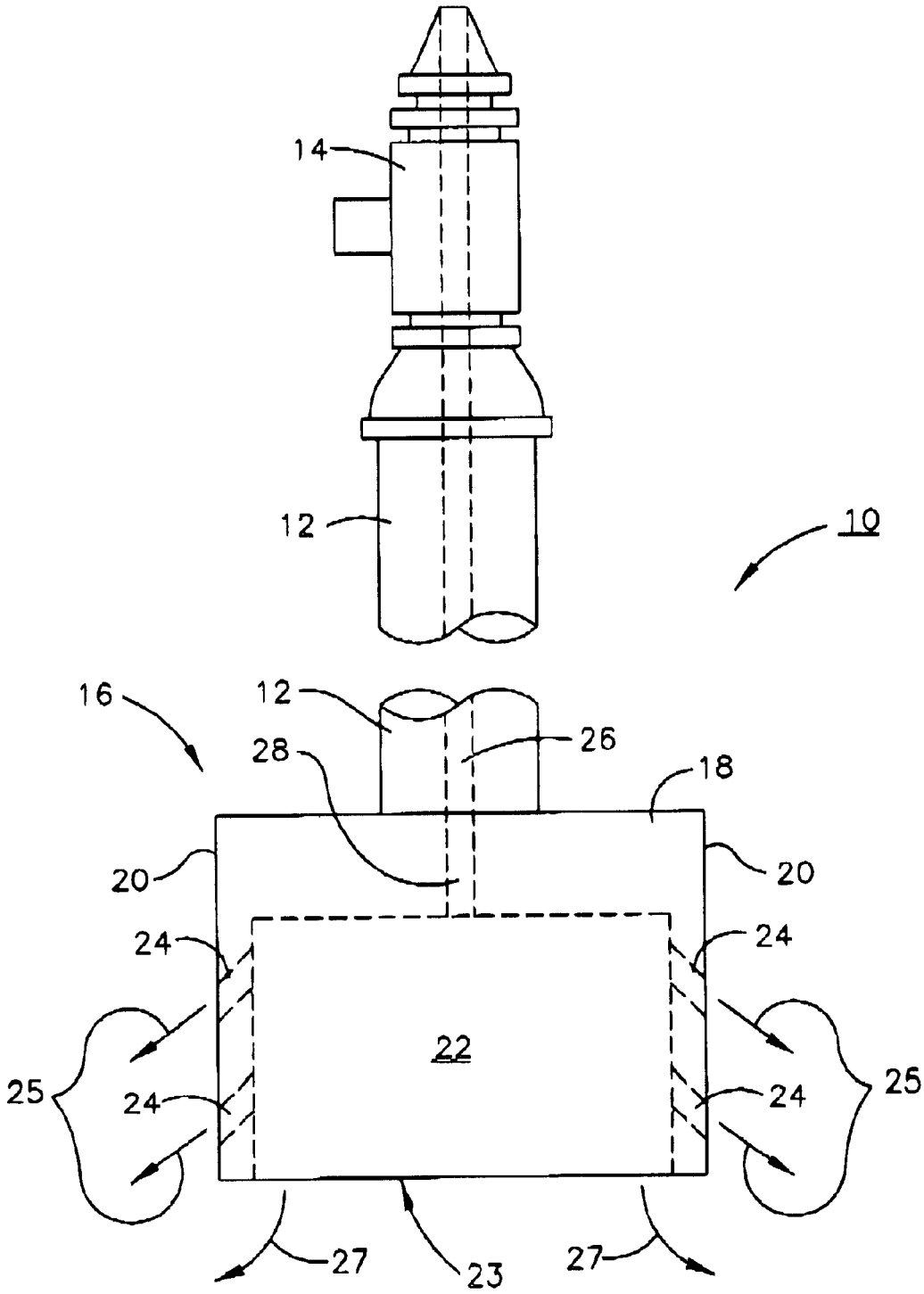
FIG. 1 is a partially phantom elevational view of the molten metal fluxing apparatus of the present invention.

Referring now to FIG. 1, fluxing apparatus 10 of the present invention comprises a gas conduit 12, hereinafter referred to interchangeably as a conduit or a wand, a gas flow control mechanism 14 for controlling the flow of gas through conduit 12 and a head 16. Head 16 is shaped like an inverted cup having a "top" 18 (what would normally be called the "bottom" of an upright cup) a peripheral wall 20, an interior 22 and an open "bottom" 23 (what would normally be called the "top" of an upright cup). Apertures 24 are provided in peripheral wall 20. Apertures 24 permit the escape of gas supplied to interior 22 of inverted plunger cup 16 via passages 26 and 28 in conduit 12 and top 18 respectively through apertures 24 as well as through open bottom 23 as shown by arrows 25 and 27 when adequate gas flow is provided.

Figure 2:
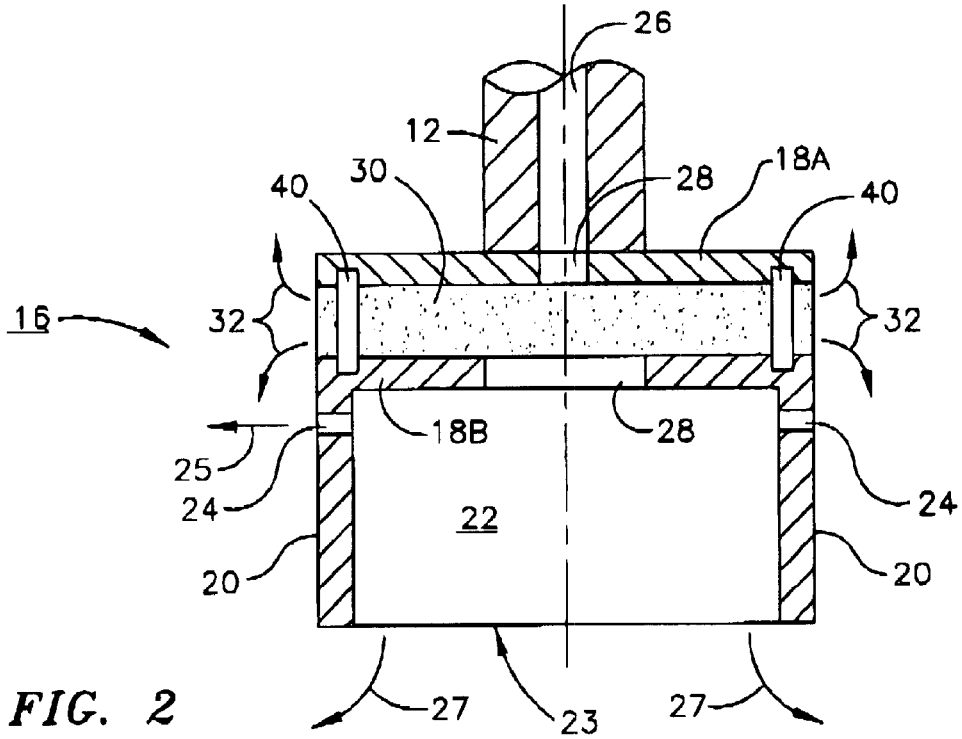
FIG. 2 is a cross-sectional view of one embodiment of the head portion of the molten metal fluxing apparatus of the present invention.
Figure 3:
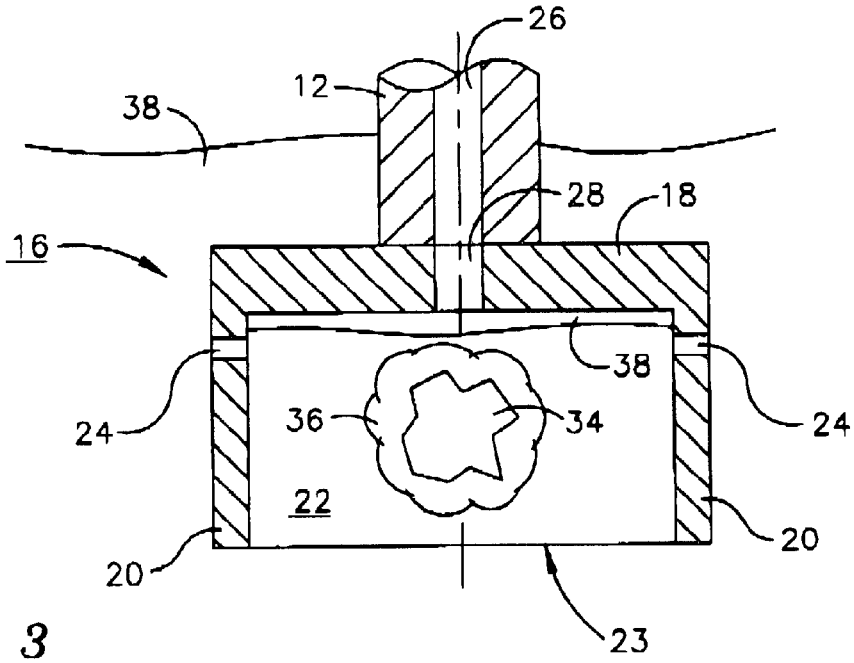
FIG. 3 is a cross-sectional view of alternative embodiment of the head portion of the molten metal fluxing apparatus of the present invention.

Apertures 24 may be horizontal as shown in FIGS. 2 and 3 or angled downward as shown in FIG. 1. The particular angularity of apertures 24 being considered largely a matter of design choice given the variables and usage of a particular installation. Similarly, the number of apertures provided may vary, depending upon the fluxing operation being performed, the metal being treated, etc.

In the embodiment depicted in FIG. 2, top 18 of head 16 is divided into two portions 18A and 18B and includes a porous disc 30 fabricated, for example, from porous graphite, open-celled ceramic foam or the like all, of the types commonly used in the metals processing industry. According to the preferred embodiment of head 16 depicted in FIG. 2, gas is supplied through passage 26 to porous disc 30 via passage 28. A portion of the gas exits into the molten metal through porous disc 30 about the periphery thereof as shown by arrows 32 and the balance of the gas passes into interior 22 via the remainder of passage 28 in top portion 18B to be allowed to escape into the molten metal through apertures 24 and open bottom 23 as indicated by arrows 25 and 27 respectively. Although structurally somewhat less desirable, top portion 18B could be dispensed with entirely and porous disc 30 simply joined to top portion 18A using a suitable high temperature adhesive and reinforced with a plurality of rods 40 that join top portion 18A with peripheral wall 20.

In the preferred embodiment of the fluxing apparatus of the present invention depicted in FIG. 3, because of the open bottom design of the fluxing head 16 of the present invention, a quantity of grain refiner, alloying element(s) or other additives 34 can be placed in interior 22 of head 16 for simultaneous dissolution during the fluxing operation. It is preferred that such additives be wrapped in a layer of a suitable foil 36 for containment during insertion into interior 22, plunging of head 16 containing additives 34 into a body of molten metal as shown in FIG. 3. Upon plunging of head 16 including foil wrapped additive(s) 34 into molten metal 38, molten metal 38 is permitted to enter interior 22 as shown in FIG. 3. The presence of molten metal 38 results in the dissolution of foil 36 and contained additive(s) 34. The flow of gas within interior 22 accompanied by the concomitant turbulence caused by such flow and the flow of gas as shown by arrows 25, 27 and 32 results in diffusion or dispersion of additives 34 in a dissolved state along with the gas into molten metal body 38. This action of the fluxing gas enhances the mixing of the additive(s) with the molten metal and helps to assure a better distribution of the additive(s) 34 within molten metal 38. This clearly results in a more uniform distribution of additive(s) 34 in the molten metal than would otherwise be possible if additive(s) 34 were simply thrown into the molten metal and H one relied upon the forces of thermal convection within the molten metal to disperse them.

While plunger cup or head 16 may have any of a variety of shapes, it is clearly preferred that peripheral 20 be cylindrical so as to provide an optimized distribution of gas from apertures 24.

Additive package 34 may comprise any of the appropriate conventional additives dissolved in molten metal during the fabrication process. These include by way of example, but not exclusively, sodium, strontium, grain refiners such as titanium for aluminum, borax compositions for the treatment of copper, aluminum removal additives such as Eliminal® available from Pyrotek, Inc, Spokane, Wash. used in the treatment of copper, Cuprit®49 also available from Pyrotek, Inc, Spokane, Wash. that is used as a cover flux for yellow brass, calcium removers, etc. The particular composition or physical form, tablet, powder, granules, etc. of additive(s) 34 not being of any particular criticality to the successful practice of the present invention.

Wand/conduit 12 and head 16 may be fabricated from any suitable material, including particularly graphite and suitable ceramic materials of the types conventionally used in the treatment and handling of molten metals of the types discussed herein. As long as the material is adequately formable and sufficiently resistant to molten metal it should be considered suitable for fabrication of fluxing apparatus 10.

Thus, while the materials of construction of device 10 can be varied greatly depending upon the particular application thereof, steel, copper or aluminum degassing, for example, it is preferred that tube 12 and head 16, including porous disc 30, be fabricated from graphite since this material is relatively inert to these materials at their normal molten processing temperatures. Top 18 and peripheral wall 20 of head 16 can accordingly be fabricated from a dense, i.e. non-porous, graphite, while disc 30 will be fabricated from a porous graphite of a type commonly used and well known in molten metal handling arts.

While graphite is the preferred material of construction for device 10, other materials such as ceramics of various types, alumina, silicon carbide, boron carbide etc., can also be used to fabricate head 16 including disc 30, if porous versions of the material are available. Mixed materials, for example, a graphite disc 30 and ceramic portions 18 and 20 can also be used to successfully assemble device 10 in accordance with the present invention. In such a situation, porous disc 30 and ceramic portions 18 and 20 can be joined with a suitable high temperature adhesive, e.g. a graphite-epoxy cement or the like. Reinforcing rods 38 that are fastened into top portion 18A and pass through porous disc 30 and into second top portion 18B might also be used to reinforce such a bond.

In use, fluxing apparatus 10 is plunged into a molten metal volume 38 with open end 23 facing vertically downward in the molten metal. Gas flow is initiated prior to plunging to inhibit metal infiltration into passages 26 and 28. Adequate gas flow is maintained so that such infiltration does not occur during use. When it is desired to take advantage of the ability of head 16 to contain additive package 34 as described above, gas flow must be regulated adequately to allow for the entry of molten metal into interior 22 (see FIG. 3) so that dissolution of additive package 34 can occur and the flow of gas out of interior 22 provides the energy required to disperse additive 34 into the molten metal 38 through apertures 24 and open end 23. Head 16 attached to wand 12 can be circulated by hand or mechanically within the body of molten metal or oriented in a stationary position in the molten metal either, as conventionally practiced in the metals fabrication industry.

As the invention has been described, it will be apparent to those skilled in the art that the same may be varied in any ways without departing from the spirit and scope of the invention. Any and all such modifications are intended to be included within the scope of the appended claims.

What is claimed is:

1. A molten metal fluxing apparatus for vertical plunging into a body of molten metal comprising:

A) an inverted plunger cup having a top, a peripheral wall, an open bottom and an interior;

B) a passage in said top for the admission of a fluxing gas into said interior;

C) a plurality of apertures in said peripheral wall that permit escape of said fluxing gas from said interior when said inverted cup is immersed in a body of molten metal; and D) a porous disc in said top between said top and said interior and having an outer periphery, said porous disc receiving fluxing gas from said passage and permitting a first portion of said fluxing gas to escape about said outer periphery and allowing passage of a second portion of said fluxing gas into said interior.

2. The molten metal fluxing apparatus of claim 1 wherein said top is divided into a first portion and a second portion and further including in said top between said first portion and said second portion, a porous disc having an outer periphery, said porous disc receiving fluxing gas from said passage and permitting a first portion of said fluxing gas to escape about said outer periphery and allowing passage of a second portion of said fluxing gas into said interior.

3. The molten metal fluxing apparatus of claim 1 further including a supply conduit for the supply of fluxing gas to said passage.

4. The molten metal fluxing apparatus of claim 2 further including a supply conduit for the supply of fluxing gas to said passage.

5. The molten metal fluxing apparatus of claim 2 further including a regulating mechanism for controlling the flow of gas to said conduit.

6. A method for the treatment of molten metal comprising:

A) immersing into a body of molten metal a molten metal fluxing apparatus comprising:

I) a gas supply line;

II) an inverted plunger cup having a top, a peripheral wall, an open bottom and an interior;

III) a passage in said top for the admission of a fluxing gas into said interior;

IV) a plurality of apertures in said peripheral wall that permit escape of said fluxing gas from said interior when said inverted cup is immersed in a body of molten metal; and V) a porous disc in said top between said top and said interior and having an outer periphery, said porous disc receiving fluxing gas from said passage and permitting a first portion of said fluxing gas to escape about said outer periphery and allowing passage of a second portion of said fluxing gas into said interior; and B) passing fluxing gas through said gas supply line to said interior so a to cause said fluxing gas to escape into said molten metal through said apertures and said open bottom.

7. The method of claim 6 wherein said top is divided into a first portion and a second portion and further including in said top between said first portion and said second portion, a porous disc having an outer periphery, said porous disc receiving fluxing gas from said passage and permitting a first portion of said fluxing gas to escape about said outer periphery and allowing passage of a second portion of said fluxing gas into said interior.

8. The method of claim 6 further including the additional step of inserting a molten metal additive package within said interior prior to immersion of said molten metal fluxing apparatus into said molten metal.

9. The method of claim 7 further including the additional step of inserting a molten metal additive package within said interior prior to immersion of said molten metal fluxing apparatus into said molten metal.

* * * * *